US005542992A

United States Patent [19]

Hashimoto et al.

[11] Patent Number: 5,542,992

[45] Date of Patent: Aug. 6, 1996

[54] TIAL BASE ALLOY HAVING HIGH STRENGTH PERFORMANCE AT HIGH TEMPERATURE

[75] Inventors: Kenki Hashimoto; Minoru Nobuki; Morihiko Nakamura; Haruo Doi, all of Tokyo, Japan

[73] Assignee: National Research Institute For Metals, Tokyo, Japan

[21] Appl. No.: 398,174

[22] Filed: Mar. 2, 1995

[30] Foreign Application Priority Data

May 2, 1994 [JP] Japan ..... 6-054807

[51] Int. Cl.[6] ..... C22C 14/00

[52] U.S. Cl. ..... 148/421; 420/418; 420/419

[58] Field of Search ..... 148/407, 421; 420/418, 419

[56] References Cited

FOREIGN PATENT DOCUMENTS

| | | | |
|---|---|---|---|
| 595980 | 4/1960 | Canada | 420/418 |
| 621884 | 6/1961 | Canada | 420/418 |
| 782503 | 9/1957 | United Kingdom | 420/418 |

*Primary Examiner*—John Sheehan
*Attorney, Agent, or Firm*—Wenderoth, Lind & Ponack

[57] ABSTRACT

A TiAl base alloy containing 46 to 54 mol % of Ti and 46 to 52 mol % of Al in which Sb is added within a range of 0.1 to 1 mol %, at least one element of Hf and/or Zr is further added within a range of 0 to 3 mol %, and three phases of a γ phase, an $\alpha_2$ phase and Sb-rich phase coexist.

3 Claims, 6 Drawing Sheets

100 μm

100 μm

TIAL BASE ALLOY HAVING HIGH STRENGTH PERFORMANCE AT HIGH TEMPERATURE

FIELD OF THE INVENTION

The present invention relates to a TiAl base alloy having a high strength performance at high temperatures. More particularly, the present invention relates to a TiAl base alloy which has a high strength performance at high temperatures as well as a sufficient elongation performance at room temperature.

DESCRIPTION OF THE PRIOR ART

A lightweight heat-resistant material is important for improving energy efficiency of aero-space equipments and engines. A TiAl system intermetallic compound has been conventionally focused as a candidate for that material, and many studies have been conducted for commercialization. As a result, some problems regarding ductility at room temperature and moldability, which is defective to practical utilization, have been solved. A further development is now desired with respect to an improvement of a strength performance at high temperatures.

For the sake of this, one way has been proposed in which very fine particles are precipitated by such an additive as C, N and O. Another way is solid solution of such an element as Nb or Ta within a range of 3 to 10%.

In the former way, however, the precipitated particles tend to become instable at high temperatures of nearly 1000° C., and thus a high strength performance has not been obtained. In the latter way, on the other hand, the high strength performance has been realized, but the way needs improving in terms of a production cost and weight for commercialization.

Further another way is also proposed in which a $TiB_2$ is dispersed to reinforce the alloy, but any particle in submicron order has not been obtained so far.

The present invention an object to improve its strength at high temperatures while keeping an elongation performance at room temperature sufficient. This invention has another object to realize these with a good cost performance.

These and other objects, features and advantages of the present invention will be more apparent with reference to the following description and drawings.

DETAILED DESCRIPTION OF THE INVENTION

Figure 1:
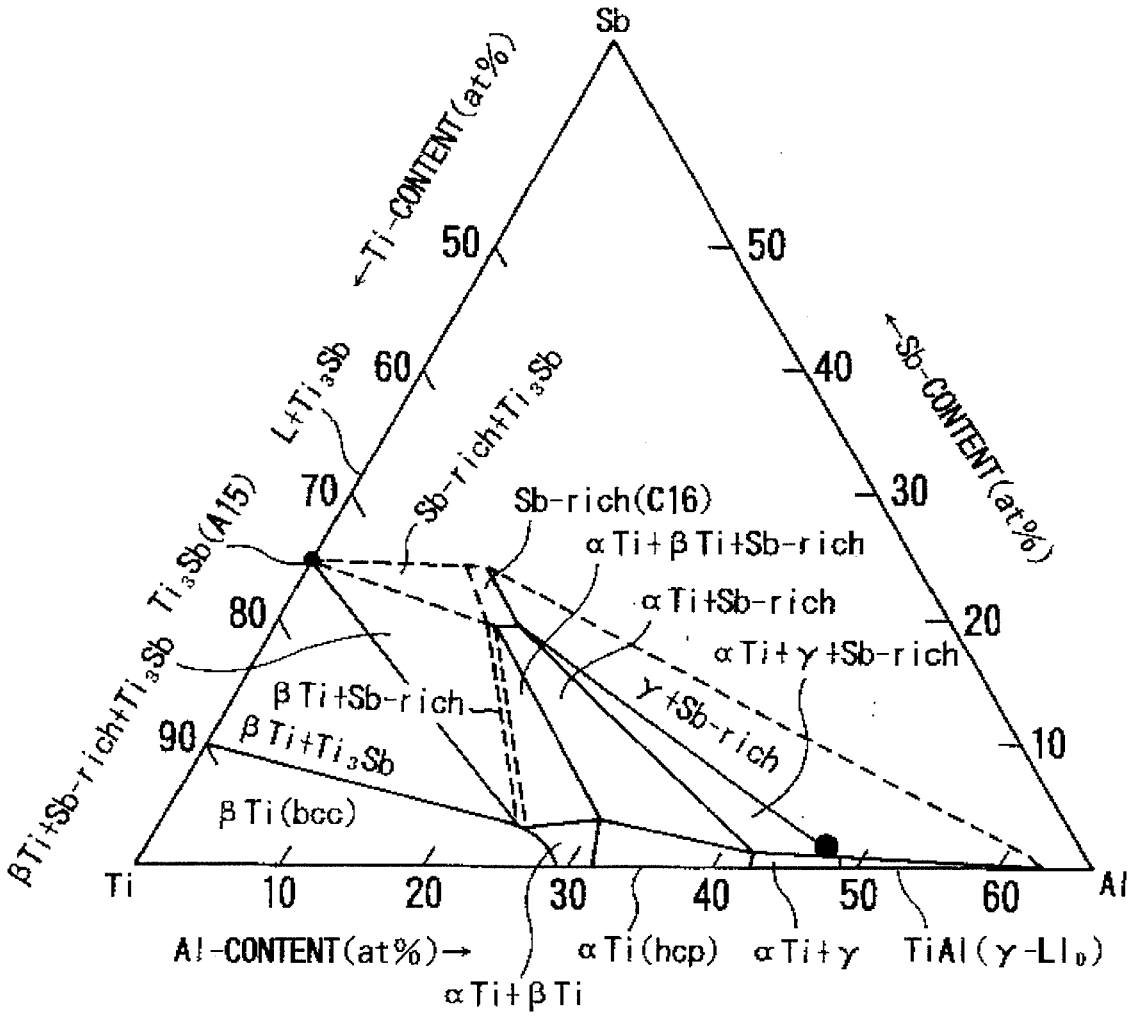
FIG. 1 shows an equilibrium diagram for ternary system of Ti—Al—Sb at 1200° C.

The present invention provides a TiAl base alloy comprising 46 to 54 mol % of Ti and 46 to 52 mol % of Al, wherein Sb is added in said alloy within a range of 0.1 to 1 mol %, at least one element selected from a group consisting of Hf and Zr is further added within a range of 0 to 3 mol %, and three phases of a $\gamma$ phase, an $\alpha_2$ phase and a Sb-rich phase coexist.

This invention also provides an embodiment to keep a good ordinary-temperature-elongation of a TiAl base alloy in which an $\alpha_2$ phase and a Sb-rich phase in fine-particle size coexist together with a $\gamma$ phase, each of which is contained in the alloy within a range of 2 to 10 vol. %.

An alloy of the present invention shows very high values for its strength performance compared with those of the conventional TiAl system compound at 1000° C. to 1100° C. This alloy may be prepared by a typical arc melting method, for example, and shows an elongation performance of more than 2% which is integral to commercialization. This elongation is more excellent than that of the conventional TiAl-$\gamma$ single phase alloy.

The alloy of this invention has compositions where main three phases consisting of a $\gamma$ phase ($L1_0$ structure) as a base, an $\alpha_2$ phase ($DO_{19}$ structure) and a Sb-rich phase ($D8_m$ structure) coexist. The structure of this alloy is very stable at a temperature range (below 1200° C.) at which a material is typically used. The alloy also has a good elongation performance by dispersion of the Sb-rich phase in submicron size and a moderate amount of the $\alpha_2$ phase having a plate-like shape. These phases easily form through a heat-treatment at a temperature range of 1100° C. to 1350° C. This contributes to an easy production of the alloy.

More specifically, the plate-like $\alpha_2$ phase ($Ti_3Al$ phase, $DO_{19}$ structure) is precipitated in the TiAl base alloy containing 46 to 54 mol % of Ti and 46 to 52 mol % of Al and having the $\gamma$ phase ($L1_0$ structure) as a base. This precipitation gives the alloy an ordinary-temperature-elongation of more than 2% and guarantees to keep a ductility performance at room temperature sufficient. It is preferable for preserving the ductility performance that the $\alpha_2$ phase is contained in the alloy within a range of 2 to 10 vol. %.

Addition of a small amount of Sb from 0.1 to 1 mol % causes the Sb-rich phase ($D8_m$ structure) in fine-particle size within submicron order, for example, nearly 10 to 40 nm, to fix deforming dislocations, thus improving a strength performance at high temperatures of more than 1000° C. Any excessive amount, e.g., more than 1 mol % of Sb enlarges the particle of the Sb-rich phase, failing to fix deforming dislocations.

The Sb-rich phase is dispersed more finely when 0 to 3 mol % of at least element of Hf or Zr, or both is added. In the case of using both of the additives, the molecular fraction is counted in total amount. Any excessive amount, more than 3 mol %, of these elements brings about a large amount of precipitation of the $\alpha_2$ phase and large particles of the Sb-rich phase, thus deteriorating the strength performance at high temperature of more than 1000° C. It is preferable for the fine Sb-rich phase to be contained in the alloy within a range of 2 to 10 mol %.

Both Hf and Zr which belong to the same IV A group in the periodic table are analogous to each other for chemical properties. For this reason, either of them may be added in the alloy, or part of one may be replaced with the other without losing those functions and effects mentioned above.

It is further possible in the alloy of the present invention to add a small amount of one or more element selected from a group consisting of Sn, Mn and Si in the alloy.

More particularly, these Sn, Mn and Si may be added by various modifications such as a single element; a mixture which two elements are mixed with a combination of Sn and Mn, Sn and Si, or Mn and Si; a mixture containing all these elements. In every modification, the amount of the additive is within a range of 0 to 3 mol % in total.

These elements are known to contribute to increasing the density of interfacial dislocations, by which their addition is considered to be effective for keeping a high ductility at room temperature.

EMBODIMENTS

Example 1

A material conducted an arc melting under the argon atmosphere, which respectively contains 50, 49.6 and 0.4 mol % of Ti, Al and Sb, was subjected to a homogenizing treatment for 3 hours at 1200° C. The position of this alloy at 1200° C. in the equilibrium diagram is marked by black circles in FIG. 1.

Figure 2:
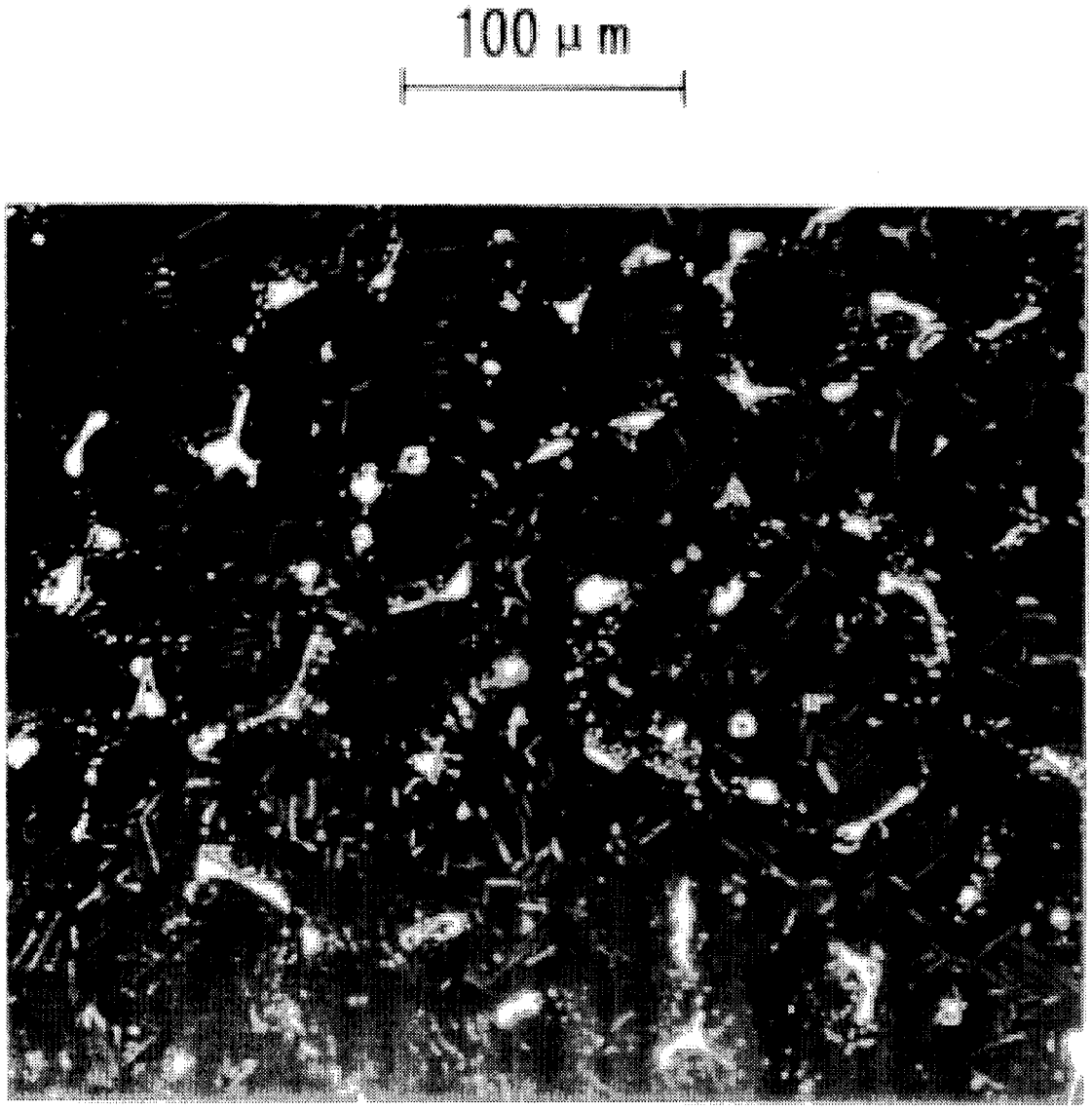
FIG. 2 is a SEM photograph showing a structure of an alloy of Example 1.

An observation of the structure of the alloy disclosed that an $\alpha_2$ phase ($Ti_3Al$) and a Sb-rich phase were contained as a precipitation in a base of the $\gamma$ phase with a volume fraction of approximately 2 to 8% and 2 to 9%, respectively. This is shown in FIG. 2. The average size of the $\gamma$ phase grain was approximately 100 μm.

Figure 3:
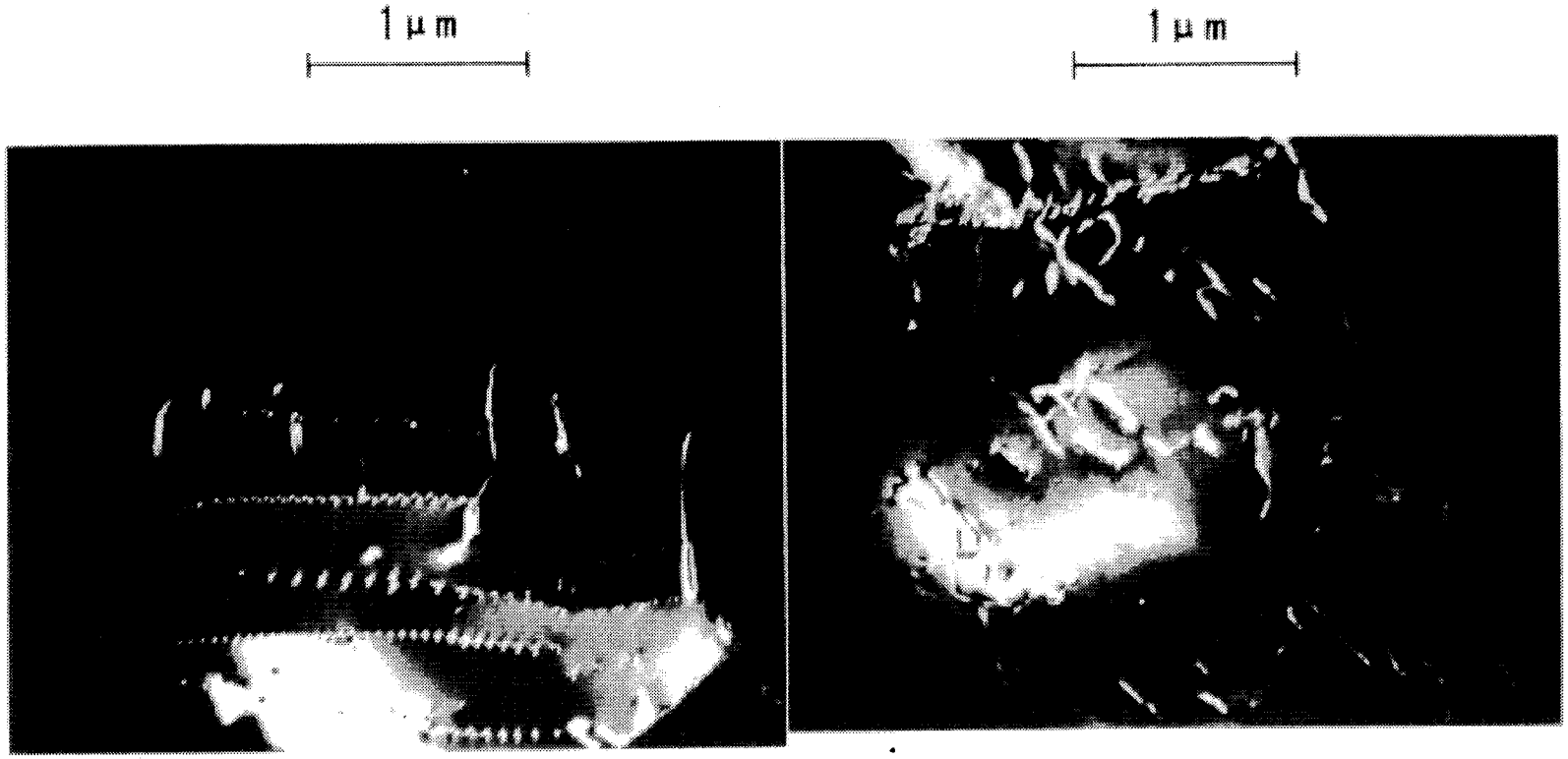
FIG. 3 is a TEM photograph showing a state of plastic deformation of an alloy of the present invention.

The alloy showed an elongation performance of 2.3% at room temperature. Each of the strength performances (proof stress) at high temperatures of 1000° C. and 1100° C. was 230 MPa and 160 MPa. This improvement caused by adding a small amount of Sb is probably due to reinforcement accompanied by solid solution and such fixation of deforming dislocations by the Sb-rich phase of 10 to 40 nm in particle size as shown in FIG. 3. FIG. 3 shows the state of plastic deformation after a compression test performed at 1000° C. As an excessive amount of Sb is added, the Sb-rich phase becomes so large that fixation cannot occur. Nearly 2 to 10 vol.% of the $\alpha_2$ phase, i.e., the $Ti_3Al$ phase, is useful for obtaining an good ordinary-temperature-elongation. It is preferable for precipitating the $\alpha_2$ phase in the limited amount to conduct a heat-treatment at a temperature range of 1000° to 1330° C. for more than an hour.

It was confirmed that the alloy produced showed higher values for the strength performance at high temperatures than those of the conventional TiAl system alloy at 1000° C. and 1100° C. and that the alloy was excellent in a strength performance at high temperatures as well as in ductility.

Figure 4:
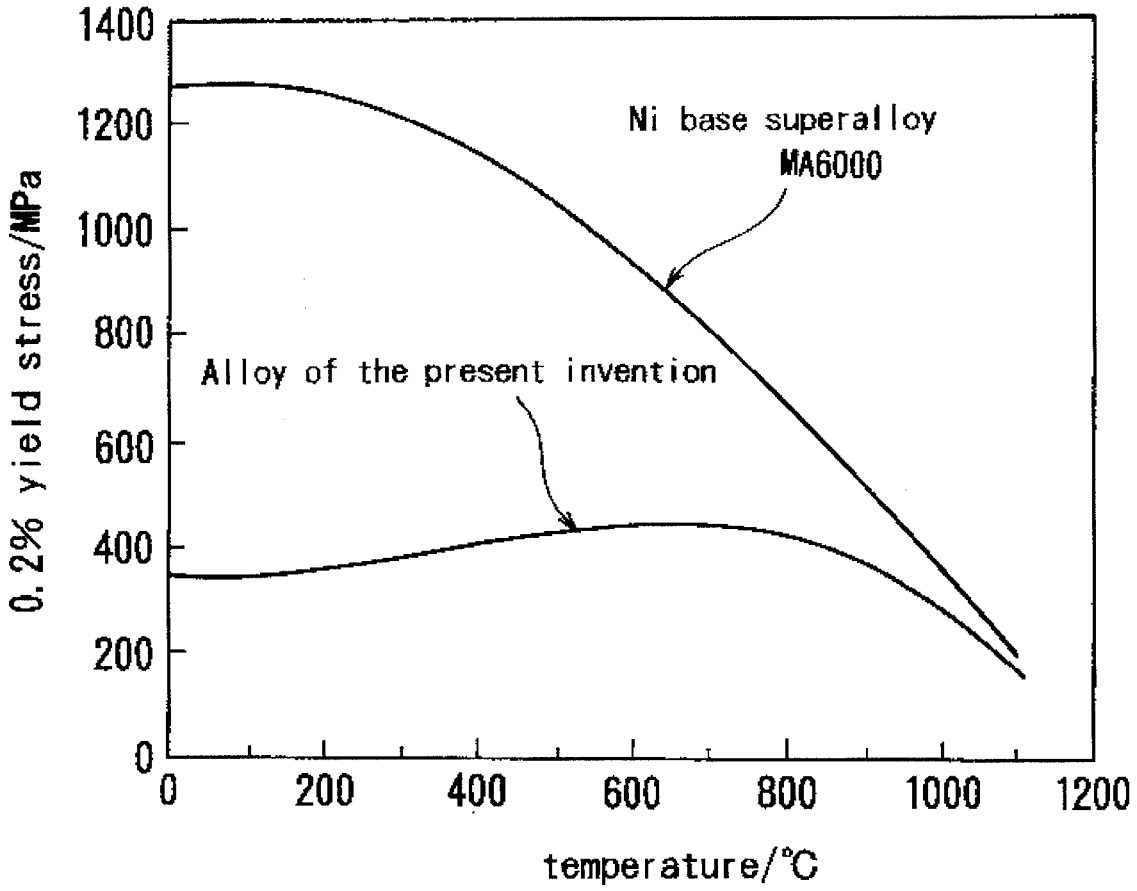
FIG. 4 shows a relationship between temperature and 0.2% stress for Ni-base alloy (MA6000) for comparison with an alloy of this invention.

FIG. 4 shows a comparison of the alloy of the present invention with a well-known Ni-base alloy (MA6000). It is understood that the alloy of the present invention is superior to the conventional Ni-base alloy.

Example 2

Figure 5:
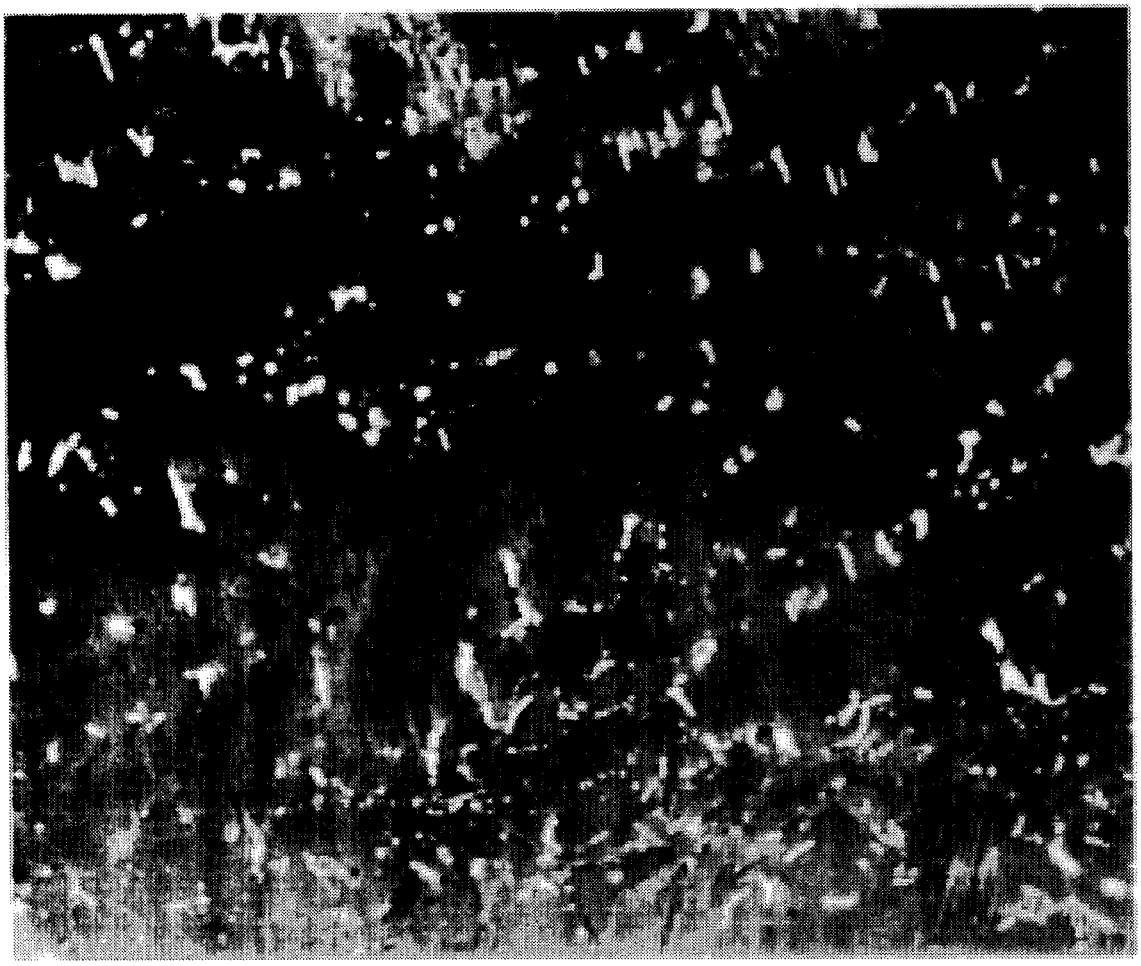
FIG. 5 is a SEM photograph showing a structure of an alloy of Example 2.

A material conducted a arc melting under argon atmosphere, which respectively contains 49, 49.6, 0.4, and 1 mol% of Ti, Al, Sb and Hf, was subjected to a homogenizing treatment for 3 hours at 1200° C. An observation of the structure of this alloy disclosed that almost the same structure as described in Example 1 was formed but that volume fractions of the precipitates were slightly increased to 3 to 9%. This is shown in FIG. 5.

This alloy showed an elongation performance of 2% at room temperature. The strength performances at 1000° C. and 1100° C. were 250 MPa and 160 MPa, respectively. It was confirmed that this alloy has not only an excellent ductility at room temperature but also an excellent strength performance.

Addition of approximately 1 at % of Hf in the alloy of Example 1 is effective for dispersing the Sb-rich phase much more finely, thus improving a strength performance. On the contrary, any excessive amount of Hf, more than 3 mol %, brings about a large amount of the $Ti_3Al$ phase and harmful growth of larger particles of the Sb-rich phase, deteriorating the strength performance.

Example 3

Almost the same material except a substitution of Hf with Zr as that of Example 2 was prepared.

The structure of this alloy was closely analogous to that of the alloy of Example 2. The alloy showed an elongation performance of 2% at room temperature and strength performance of 250 MPa and 150 MPa at 1000° C. and 1100° C., respectively. It was confirmed that an alloy having both an excellent ductility and an excellent strength was also prepared by adding Zr.

It is reasonably considered from this fact that functions and effects described in Examples 1 and 2 are true of the alloy in this case of a partial substitution of Hf with Zr.

COMPARISON

Figure 6:
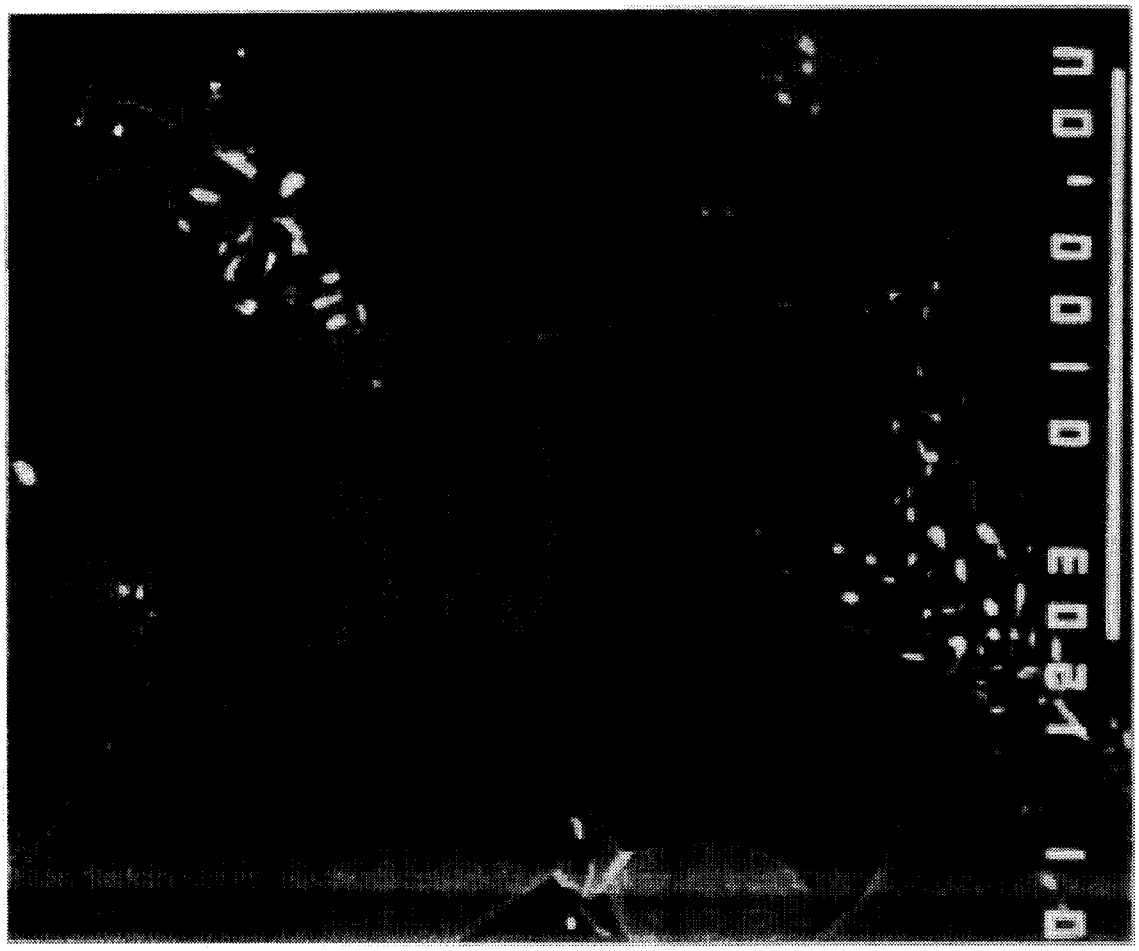
FIG. 6 is a SEM photograph showing a structure of an alloy of Example 3.

For the purpose of comparison with these examples, a material containing only Ti and Al of 50 mol % was prepared, which was conducted the same arc dissolution under the argon atmosphere and subjected to the same homogenizing treatment for 3 hours at 1200° C. The structure of this alloy is shown in FIG. 6.

The alloy showed an elongation performance of 2.3% at room temperature, but a strength performances were, at best, 160 MPa and 80 MPa at 1000° C. and 1100° C.

As described above in detail, the present invention provides a new practical lightweight heat-resistant alloy having an excellent strength performance as well as an excellent elongation performance at room temperature. Its production may be easy with a good cost performance. It is anticipated that this new alloy will contribute to improve an energy efficiency of aero-space equipments and engines.

It is needless to mention that this invention is not limited by embodiments above-mentioned.

What is claimed is:

1. A TiAl base alloy consisting essentially of 46 to 54 mol % Ti, 46 to 52 mol % Al, 0.1 to 1 mol % Sb, and 0 to 3 mol % of at least one element selected from the group consisting of Hf and Zr as an additive, said alloy having a three-phase microstructure where a $\gamma$ phase, an $\alpha_2$ phase and an Sb-rich phase coexist.

2. A TiAl base alloy as claimed in claim 1, wherein both said $\alpha_2$ and Sb-rich phases have shapes in fine particle size, each of which is contained in said alloy within a range of 2 to 10 vol. %.

3. A TiAl base alloy as claimed in claim 1, wherein at least one element selected from the group consisting of Sn, Mn and Si is further added as an additive within a range of 0 to 3 mol %.

* * * * *